US006544598B1

(12) United States Patent
Swei et al.

(10) Patent No.: US 6,544,598 B1
(45) Date of Patent: Apr. 8, 2003

(54) ELECTROSTATIC PROCESS FOR DEPOSITING ABRASIVE MATERIALS

(75) Inventors: Gwo Shin Swei, East Amherst, NY (US); Sylvain Petigny, Tonawanda, NY (US)

(73) Assignee: Saint-Gobain Abrasives Technology Company, Worcester, MA (US)

( * ) Notice: Subject to any disclaimer, the term of this patent is extended or adjusted under 35 U.S.C. 154(b) by 0 days.

(21) Appl. No.: 09/963,810

(22) Filed: Sep. 26, 2001

(51) Int. Cl.[7] ..... B05D 1/04

(52) U.S. Cl. ..... 427/458; 427/475; 427/477; 427/482

(58) Field of Search ..... 427/458, 459, 427/475, 477, 482; 51/295, 308, 309; 361/226; 118/627

(56) References Cited

U.S. PATENT DOCUMENTS 4,481,557 A * 11/1984 Woodruff
5,011,513 A * 4/1991 Zador et al.

* cited by examiner

*Primary Examiner*—Fred J. Parker
(74) *Attorney, Agent, or Firm*—David Bennett

(57) ABSTRACT

The use of a solid state waveform generator together with a suitable non-inverting amplifier provides a very versatile system for depositing particles on a substrate by an upward deposition, or "UP", technique.

7 Claims, No Drawings

ELECTROSTATIC PROCESS FOR DEPOSITING ABRASIVE MATERIALS

BACKGROUND OF THE INVENTION

This invention relates to a process for the deposition of abrasive materials by an electrostatic technique and to the equipment used to bring about such deposition.

In the production of coated abrasives by a process in which an abrasive grain is deposited on an uncured or partially cured binder material the most common deposition technique involves electrostatic deposition in which the grain is projected upwards under the influence of an electrostatic field into contact with the binder. These are usually described as UP (for upward projection) processes. The grain is fed from a hopper to a moving belt which is passed through a deposition location, defined by a charged plate located below the moving belt and directly opposite and parallel to a grounded plate located above the moving belt. The substrate on to which the grain is to be deposited follows a path parallel to and above the moving belt as they both pass through the deposition location. The electrostatic field between the charged plate and the grounded plate causes the grain to be projected upwards towards the down-facing surface of the substrate where it adheres to an uncured or partially cured binder coated thereon.

The uniformity of the coating therefore clearly depends on the uniformity of the electrostatic field by which the grain is propelled to the substrate. In a typical process of the prior art, the field is generated by a transformer which is used to generate high voltage AC signals of 0 to 60 kilovolts (kV) with the capability for varying the frequency from a few Hertz (Hz) up to 30 or 40 Hz. In a typical set up the power supply consists of a motor generator feeding a high-voltage transformer to generate a high voltage output. The transformer delivers the output signal by means of a set of primary and secondary induction coils. In an "auto-transformer" the coils are superimposed on one another. Because of the design of such power supplies, a sealed, non-changeable type of waveform is generated and this is usually square or sinusoidal. Most often only a narrow frequency range from about zero up to about 30–40 Hz is available because of excessive distortion of the high voltage signal that occurs at higher frequencies. These limitations often lead to defects in the uniformity of the coating pattern. Such lack of uniformity is not a serious problem where the grits are relatively coarse and high grain weights are deposited because the heavy loading conceals any non-uniformity. However if the grains are relatively small, for example 220 grit and finer, and the grain weight deposited is relatively light, defects known as "chatter marks" become very evident and may render the product unacceptable to a customer. Since the same UP grain deposition line is usually used for a range of grit sizes and grain weight deposition levels, the final design tends to be a compromise that does very few things very well.

There is therefore a need to provide a "UP" grain projection process that is adaptable to processes for the deposition of coarse or fine grit in heavy or light deposition weights by a simple adjustment. The present invention provides a UP process adaptable to any grain weight deposition level using very fine abrasive particles that does not result in chatter marks. The process is moreover much less expensive to operate since it consume a maximum of 2 kVA as opposed to a typical transformer power consumption of 5–6 kVA.

DESCRIPTION OF THE INVENTION

The present invention provides a UP process for the deposition of particulate material on a substrate which comprises generating a projection field using a solid state function generator capable of generating a range of waveforms, selecting a signal having a desired waveform and feeding said signal through a solid state non-inverting amplifier to generate a UP projection field and using said projection field to bring about deposition of the particulate material on the substrate.

The invention is most suitably applied to the deposition of abrasive grits on a substrate and this shall be the context in which the invention is most particularly described. However it should be understood that the general principles embodied in the invention are not so limited.

By substituting a solid state function generator, which has an infinitely variable output in terms of waveform even while in operation, as opposed to a transformer which is to some extent has a waveform output based on the transformer design and has little or no capacity for variation during operation. The use of a solid state non-inverting amplifier in conjunction with the function generator allows the output to reach the necessary AC voltage to generate a suitable projection field. This was quite unexpected because whereas the typical transformer generated field uses voltages of 50–60 kV, the maximum voltage available using the system of the invention is only about +/−30 kV and yet the uniformity and the controllability of the system makes the fields generated at such voltages completely adequate to yield excellent results except where very heavy particles are to be deposited.

Having the capacity to vary the waveform and the frequency allows the operator to design a waveform that is suitable for the product being produced and avoids the development of chatter marks which indicate a non-uniform deposition as a result of inhomogeneities in the electrostatic field.

The use of the field generation equipment specified by the present invention permits the generation of any suitable waveform such as DC, pulsed DC, square, sinusoidal, triangle, or even a customized waveform adapted to the specific application. The selected waveform can be amplified to deliver high voltages in a very broad frequency bandwidth. This contrasts markedly with transformed-based technology which delivers a single waveform within a narrow range of frequencies, (generally up to 30–40 Hz).

The variability of the frequency is a very important feature of the present invention since it is often found that, under conditions that generate chatter marks, these may be eliminated by operating at a field frequency of from 45–60 Hz as opposed to the 30–40 Hz typical of transformer-based technology.

By contrast a suitable non-inverting amplifier such as Model 30/20 sold by Trek Inc., which has a fixed gain of 3000 V/V, used in conjunction with a standard 1 MHz function generator, (Model FG3B from Wavetek), can deliver output voltages, for a range of different waveforms, in the range of 0 to +, −30 kV DC or peak AC for frequencies varying from 1 Hz to 1 MHz.

In addition and most importantly the waveform and the frequency can be changed "on the fly" so as to enable the operator to tailor the high voltage signal, and hence the field generated, to a specific product or set of operating conditions. This ideally will lead to better control of deposition and therefore product quality, especially when operating at low grain deposition weights. It will also provide better economics since voltages of up to about 30 kV can be used instead of 50–60 kV which are typically used with deposition fields generated using transformer-based technology.

DESCRIPTION OF THE PREFERRED EMBODIMENTS

To illustrate the invention several different deposition techniques were used and compared with deposition techniques according to the invention with particular reference to the occurrence of chatter marks.

The Comparative Examples 1 and 2 used a conventional autotransformer to generate a waveform with a voltage of +/−20 kV and a frequency of 30 Hz. In Comparative Example #1 the waveform was square and the grit was 220 grit alumina and in Comparative Example #2 the waveform was square and the grit was P1500 alumina.

These were compared against the waveform generating equipment according to the invention. In each case a Wavetek F3GB function generator was used as the basic power supply and the amplifier was non-inverting Trek amplifier model 30/20.

The results are set out in the following Table.

| | Comp .#1 | Inv. #1 | Inv. #2 | Inv. #3 | Comp .#2 | Inv. #4 |
|---|---|---|---|---|---|---|
| GRIT | 220 | 220 | 220 | 220 | 1500 | 1500 |
| FREQUENCY | 30 Hz | 30 Hz | 30 Hz | 50 Hz | 30 Hz | 50 Hz |
| WAVEFORM | Square | Sine | Square | Square | Square | Sine |
| WEIGHT* | 41.5 | 39.5 | 41.5 | 41.5 | 20 | 20 |
| CHAT.MKS | YES | NO | YES | NO | YES | NO |

"WEIGHT" indicates the weight of grain deposited in grams per square meter.

"CHAT.MKS" indicates whether or not chatter marks were observed.

From the above it can be seen that, by comparing Comp. #1 with Inv. #1, changing the wave form from square to sinusoidal reduced the add-on weight and eliminated chatter marks. Inv. #3 shows that operating at the same conditions as in Corn. #1 also gave chatter marks but that these could be eliminated by raising the frequency to 50 Hz from 30 Hz. These first four tests therefore illustrate that chatter marks can be eliminated by variation of waveform or by increasing the frequency. Both these changes can be carried out while deposition is actually in progress using the teaching of the present invention.

The same result is noted in the comparison of Comp. #2 with Inv. #4. In this case the alumina was P1500 grit size where chatter marks are much more difficult to avoid and/or conceal. This comparison shows that using the equipment taught by the present invention and increasing the frequency from 30 to 50 Hz eliminated the incidence of chatter marks.

The process of the invention can be used to deposit abrasive grains on a substrate such as a flexible backing coated with a maker coat. It can however also be used to deposit a functional powder on the surface of an engineered abrasive. An engineered abrasive is one in which the surface is given a pattern comprising structures formed from a mixture of abrasive particles dispersed in a curable binder. A functional powder may be deposited on such a surface either to make the surface easier to form into the desired structures or to provided the surface with a desired characteristic. Typically the functional powder is a fine abrasive but equally it could be a mixture of such abrasives and a grinding aid or some other additive to confer, for example, antistatic or anti-loading properties.

What is claimed is:

1. A UP process for the deposition of particulate material on a substrate which comprises generating a projection field using a solid state function generator capable of generating signals having a range of waveforms and frequencies, varying the signals to provide a desired waveform and frequency and feeding said signals through a solid state non-inverting amplifier to generate a UP projection field at a maximum voltage level of about 30 kV and using said projection field to bring about deposition of the particulate material on the substrate.

2. A UP process according to claim 1 in which the particulate material is an abrasive material.

3. A process according to claim 1 in which the frequency of the waveform generated is from 40 to 60 Hz.

4. A process according to claim 1 used to deposit a particulate material having a particle size of 180 grit and finer on a substrate having a surface coating provided by an uncured curable resin.

5. A process according to claim 4 in which the particulate material is an abrasive.

6. A process according to claim 4 in which the curable resin is a thermosetting resin.

7. A process according to claim 5 in which the curable resin is in the form of a maker coat applied to a flexible backing material.

* * * * *